US007170417B2

(12) United States Patent
Gamble

(10) Patent No.: US 7,170,417 B2
(45) Date of Patent: Jan. 30, 2007

(54) DECORATIVE COVER FOR SMOKE DETECTORS AND LIKE DEVICES

(76) Inventor: Gregory Gamble, 1851 Pennington Rd., Philadephia, PA (US) 19151

( * ) Notice: Subject to any disclaimer, the term of this patent is extended or adjusted under 35 U.S.C. 154(b) by 258 days.

(21) Appl. No.: 10/722,709

(22) Filed: Oct. 29, 2003

(65) Prior Publication Data

US 2004/0164869 A1 Aug. 26, 2004

Related U.S. Application Data

(60) Provisional application No. 60/448,974, filed on Feb. 20, 2003.

(51) Int. Cl.
*B08G 21/00* (2006.01)

(52) U.S. Cl. ..... 340/628; 340/630; 340/632; 340/693.5; 340/693.6; 340/693.11; 340/693.12; D11/201; D11/215; D11/132; D11/154

(58) Field of Classification Search ..... 340/628–630, 340/632, 393.11, 693.12, 693.5, 693.6; D11/201, D11/215, 132, 154
See application file for complete search history.

(56) References Cited

U.S. PATENT DOCUMENTS 4,529,976 A * 7/1985 Jameson et al. ..... 340/628

* cited by examiner

*Primary Examiner*—Julie Bichngoc Lieu
(74) *Attorney, Agent, or Firm*—John C. Dorfman

(57) ABSTRACT

A decorative cover for smoke detectors and like devices mounted on a wall or ceiling provides a cover member of a generally opaque material approximately the shape of the device it is covering and somewhat larger than the device to be covered. The cover is provided with a plurality of connector resilient legs fixed to the inside of the cover and extending towards the device to be covered in the pattern to engage selected distributed points of engagement. Cam surfaces on the ends of the resilient legs are position to laterally deflect the respective legs when they contact the distributed points of engagement. Forces imposed by the resilience of the legs while deflected are directed in opposition to one another to maintain frictional engagement at respective points of engagement. But rather than relying strictly on friction, a shoulder beyond the cam surface toward the cover is positioned to move behind structure so that the shoulder will effectively latch to the structure with the resilience of opposed legs holdings the legs in latched position. However, the resilient forces may be easily overcome by manual force in removing the cover. The outer surface of the cover may be provided selectively with color, patterned, or decorated surfaces, including advertisements or pictural scenes.

8 Claims, 2 Drawing Sheets

DECORATIVE COVER FOR SMOKE DETECTORS AND LIKE DEVICES

RELATED APPLICATION

This application takes priority from a Provisional U.S. Patent Application 60/448,974 entitled "Decorative Smoke Detector Shield", filed Feb. 20, 2003. The inventor is Gregory Gamble, an individual qualifying for small entity status.

FIELD OF THE INVENTION

The present invention relates generally to a decorative cover for smoke detectors and like devices mounted on a wall or ceiling. More specifically the present invention relates to a decorative cover, the decoration of which may be integrated with the molding process or otherwise provided by a manufacturer or may be added by a user. It is also possible to use the decorative area for advertisement or other commercial use. The decorative cover is preferably provided with resilient legs which permit it to be clipped onto a smoke detector, or like device to be covered, without the use of tools.

DESCRIPTION OF THE PRIOR ART

In the prior art various devices have been employed to make smoke detectors more attractive. Mattison in his U.S. Pat. No. 4,954,816 made his whole smoke detector in a decorative shape which may be mounted on a wall for decorative purposes as well as its functional protective function. Jamison U.S. Pat. No. 4,529,976 shows a shield separately attachable to a smoke detector and also suggests the possibility of a decorative face on its outer surface. Myer patent number 4,796,015 discloses a combination electric clock and smoke detector which is all originally built into the clock housing.

SUMMARY OF THE INVENTION

The present invention is a simple add-on cover which may be easily clipped to a smoke detector or other device without the use of tools. The cover is designed so as to not obstruct the smoke detector and to allow the smoke access to the detector. Connection means that might obscure the path of the smoke or other gaseous mixtures or substances to the detector are kept to minimal dimensions. It employs a clip-on type structure which is simple, inexpensive to manufacture and in which all the parts may be molded as a unit to provide a one piece product. The cover may be made of decorative material or may be decorated in various ways with designs or pictures applied to the exposed face. The face may be used for advertising or other commercial use as well as being purely decorative. Pictures or ads may be printed directly on the surface or on laminar sheet and adhesively applied. Alternatively, hot stamping and all other techniques of applying decorative materials may be used to apply or enhance pictures or designs of all types. The cover is provided with a plurality of narrow resilient legs which preferably use resiliency of the material of which legs are made to allow the cover to be clipped to designated parts of the smoke detector or like device. Using the inherent resiliency of the legs alone may be sufficient to hold the cover in place or, if desired, the legs may be provided with an additional latching or hooking means which the resiliency of the legs may move behind part of the structure. The length of legs and positioning of latching means may permit the cover to rest directly against the alarm cover for greater stability as shown, or be spaced away from it for better air circulation. The size of the legs can be kept narrow so as to minimize both the amount of connecting structure and the amount of obstruction, but a sufficient number of legs are required to provide the interaction between the legs to provide opposing forces which frictionally hold the cover in place. A minimum of three legs is required for both stability and the required forces. However, where the cover is made to rest directly against the smoke alarm, or other device, two opposed legs will suffice to hold it in place, but leave it unstable and vulnerable to displacement by lateral forces transverse to the legs. As an example, the legs may be distributed in a circular pattern extending away from the cover to which they are attached and provided at their ends with cam surfaces designed to contact designated points of engagement on the smoke detector, or like device. If the legs make engagement from outside, the resilient legs must all be deflected outwardly so that they will tend to apply force inwardly somewhat toward each other to engage the respective points of engagement on the smoke detector or other device. If they are designed to contact the structure from the inside, they must be provided with cams to move the legs outwardly away from each other, instead of inwardly toward each other. In either case, the resiliency of the legs works against the structure of the supporting detector to hold it frictionally in place together. Frictional force is the combined effect of the coordinated forces of each of the legs which are positioned to contact the structure in such a way as to be capable of applying opposing frictional force. The forces applied by the legs may be toward or away from each other in different designs, but always to aid each other in applying the force against the covered device that supplies the frictional force to hold them in place. The legs may also be designed with cams surfaces alternatively to move the legs inwardly or outwardly. Such structures work either with devices in which the distributed points of engagement may direct the legs inwardly or may direct them outwardly as required to attach to a particular device.

More specifically, the present invention relates to a decorative cover for smoke detectors and like devices mounted on a wall or ceiling. The cover member consists of a generally planer sheet of essentially opaque material approximately the shape of the device it is covering and somewhat larger than the device to be covered. The outer surface of the cover may be selectively colored, patterned or decorated or prepared for decoration by a decorator. A plurality of resilient connector legs is affixed to the inner side of the cover and extend toward the device to be covered in a pattern positioned to engage selected distributed points of engagement on the device. The legs are positioned on the inner side of the cover extending toward the device to engage selected distributed points of engagement of the device. In order to displace the legs relative to the distributed points of engagement, cam surfaces at the free ends of the resilient legs are positioned to laterally deflect the legs when they contact the distributed points of engagement. By such deflection, forces imposed by the resilience of the legs while deflected are directed to maintain frictional engagement at the respective points of engagement due to the collective opposed frictional forces of the distributed legs on the engagement points. In addition to the frictional engagement, each of the legs may be optionally provided with a latching shoulder beyond the cam surface on the side of the leg to be urged by resilience behind the designated distributed points of engagement. The resilience of the legs will then urge each shoulder beyond that structure as the shoulder is moved past this structure so that each shoulder on each leg will be in position to oppose gravitational and other forces acting to remove the cover from the device by engaging such structure.

SPECIFIC DESCRIPTION OF THE DRAWINGS

Figure 1:
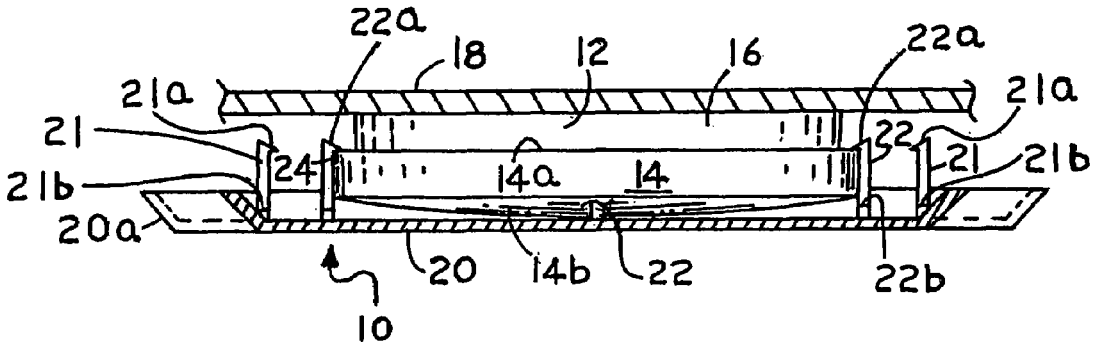
FIG. 1 is a side elevational view of a smoke detector attached to a ceiling taken along line 1—1 of FIG. 3 and having attached to it the decorative cover of the present invention, with the decorative cover structure shown partially in section.

Referring to FIG. 1, the smoke detector of present invention 10, generally designated 10, as shown may be attached to a smoke detector 12 of common circular configuration having a cover 14 extending beyond the base 16. In this particular instance, the base 16 is attached to the ceiling 18 or possibly to joists or other supporting structure above ceiling. Smoke detectors, of course, may be frequently mounted on walls and for practical purposes the ceiling 18 could be a wall as well. In this particular embodiment, the cover 14 of the device is a shallow cup or dish having short upwardly extending cylindrical walls which terminate in a rim or edge 14*a*, which in many cases is well spaced from the base 16 to provide air access. Ventilator holes may be provided as well on the face 14*b* as well. In any event, the detector, whether a smoke or gaseous detector, such as a CO or a $CO_2$ detector, depends upon the gaseous flow to reach it and enter the body of the detector. Therefore, it is important not to obscure the openings and leave sufficient room for flow. When the decorative cover is flush with the cover of the device covered it may be necessary to align access holes or other functional holes in the decorative cover to place holes matching those in the device in alignment so as to afford access for testing and not block smoke flow. Alignment means may also be employed to help align the matching holes.

For its part, the decorative cover 10 in its covering function employs a generally planer sheet 20. In this case, the sheet has an upward turned peripheral lip 20*a*, which might be described as somewhat like a pie pan. In using the term generally planer, however, it will be clear that the term is intended to encompass non-flat surfaces, particularly slightly domed surfaces which in some cases may be regarded as more attractive than the simple planer surface. In the configuration shown there are attached to the inside of the cover two concentric configurations of legs 21 and 22 arranged in a generally circular array and extending from the inner surface of the cover toward the smoke detector cover. The outer legs 21 are not used in this case but might be another time when the task is designed to fit a larger circular device. Both sets of legs are provided with break off score lines 21*b* and 22*b* at which unused legs may be broken or cut off using the small configuration of legs 22, it is not necessary to break off the outer legs, but it may be desirable to do so. When the other configuration is used the inner legs must be broken off to get them out of the way.

Figure 2:
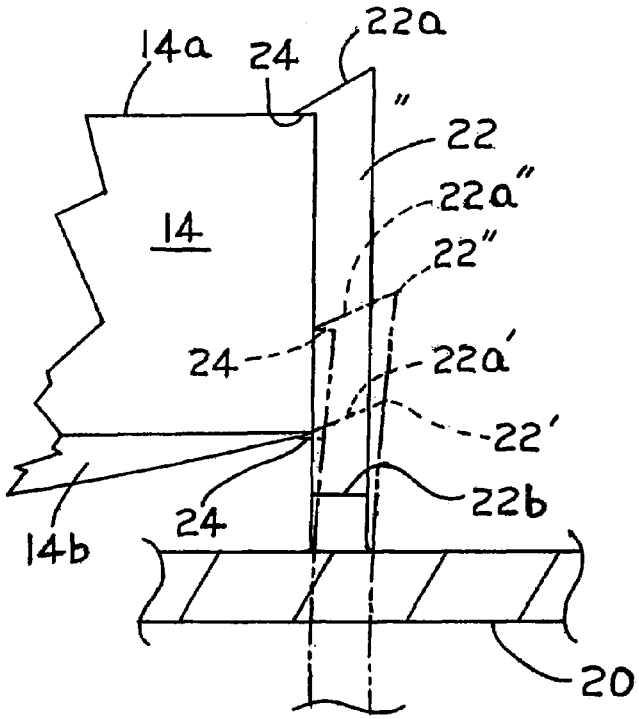
FIG. 2 is a partial view of an individual leg much enlarged from FIG. 1 and a partial view of the edge of a smoke detector showing in phantom the engagement and intermediate leg positions as the decorative cover (shown in solid lines) moves into latching engagement with the smoke detector.

The inside legs are designed to fit the smoke sensor 12. The legs are made of resilient material and arranged in their circular pattern are configured such that each of the four effective legs in the circle will have sufficient interference with the edge of the cover 14. Being resilient and somewhat flexible, especially since they have free ends, the legs 22 are able to be moved radially outwardly and away from the parts of the smoke detector, or other structure which they ultimately engage. The legs 21 and 22 are all provided with cams 21*a* and 22*a* at their respective upper free ends. Cams 22*a* at the upper ends of legs 22 in this case slope toward the cover from the outside to the inside of the array. The cam surfaces 22*a* are the first to strike the points of engagement of the cover 14 of the smoke detector and the slope of the cam surfaces tend to urge the legs outward until the legs 22 are able to slide over the sidewalls of cover 14 as seen in phantom in FIG. 2. Because they have been deflected, the legs each tend to try to restore themselves to their original position but are unable to do so and therefore apply a force inwardly against the edges of the smoke detector, thus holding the legs and the cover frictionally in place wherever it is left with the legs varying in the positions represented as it is pushed past the detector cover 14 in phantom or solid lines in FIG. 2 as the cover is pushed inward over the cover. Assuming the legs are equally spaced apart around a circular pattern, each of the legs applies a force which is to some degree opposed to the force of the other legs. In the case of four legs there are two pairs of oppositely opposed legs each opposed pair supplying full opposed force. With an odd number of legs opposes part of the force from two other opposed legs. Whatever the configuration, each of the legs contributes to maintaining the friction and holding the cover in place by friction alone as seen in FIG. 2, in the position represented in phantom view 22" and other successive positions of the leg as the legs are partially inserted over the cover. Finally, as it passes and over the lip 14*a* of the cover, the stored resilient energy force urges the legs back toward one another to the solid line position of leg 22 as seen in FIG. 2. In this position a shoulder 24, in this instance shown as immediately below the cam 22*a*, passes the lip 14*a* of cover, nothing opposes the resilient force of the leg which moves inward, at which point the shoulders 24 move under and latch against the rim. The shoulder may be formed by reducing the thickness of the leg below the cam. The shoulder 24 may be spaced further below the cam if desired. To be effective, the shoulder must not be made so far below the cam as to cause the leg to contact the ceiling as the smoke detector is being put in place.

The phantom (dashed line) showing of the movement of the leg as the cover is moved into position is intended to show the deflection of the leg as it passes the cap (in dashed lines) and then in embodiments which provide a latch shoulder it is returned to unstressed or a less stressed position in solid lines. Two dashed line (phantom) positions of the leg are shown to show the action as a cover is put in place, i.e., moved upwardly against the cover 14*b*. The first dashed line position 22' represents the position when the cams 21*a* of legs first strike the top of the detector cover 14*b*. Each cam 22*a* then is effective to move the leg outwardly into the second dashed line position 22" where the end of the cam structure above the shoulder 24 holds the leg 22. Finally, as the shoulder 24 passes the lip 14*a* and the leg returns to the solid line position of the leg 22 shown in FIG. 2. It will be observed that in this position, the shoulders 24 will tend to oppose removal of the cover, but the forces involved are not so great as to prevent removal, but rather require sufficient force to urge the legs 22 outward.

Figure 3:
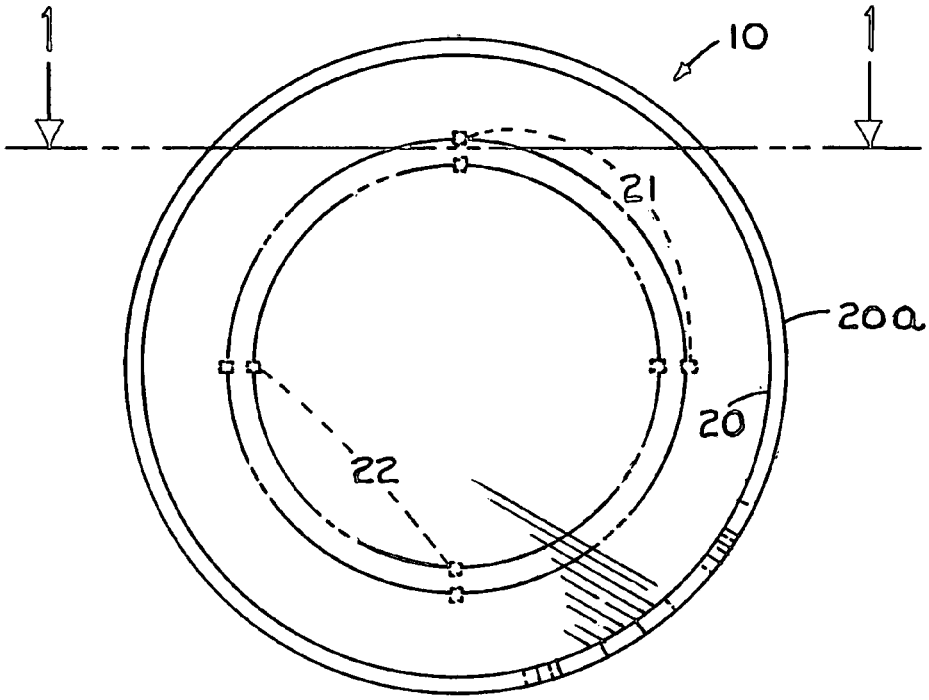
FIG. 3 is a plan view from below of the cover attached to the smoke detector.
Figure 4:
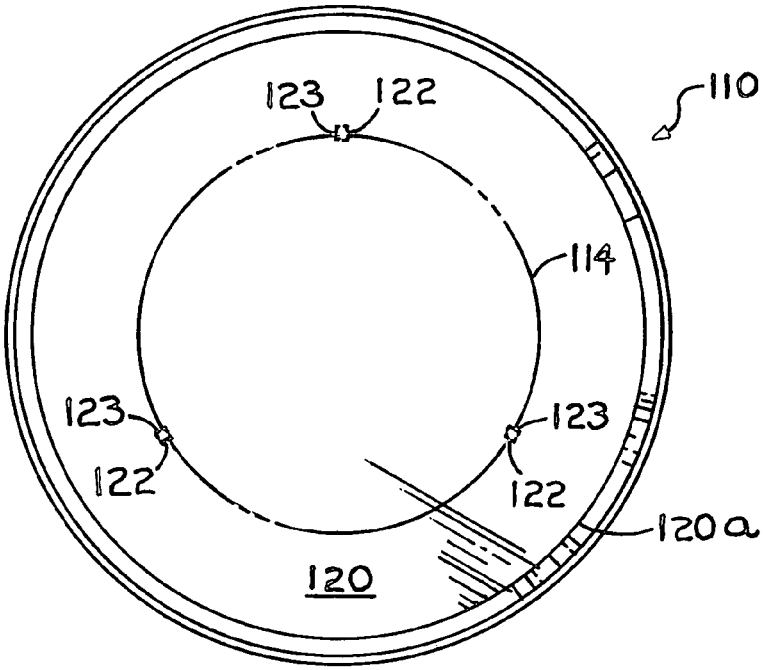
FIG. 4 is a plan view looking inside the cover of a somewhat modified smoke detector cover removed from the detector.

FIG. 4 shows a simpler variation than the structures shown in FIGS. 1–3. In FIG. 4 there are only three legs to connect the cover to the smoke detector. Three legs are sufficient when distributed essentially evenly around the circular pattern which will surround the smoke detector. In this case the opposite side of the planer cover from that shown in FIG. 3 is shown. Since it is a different structure, the cover is identified as 120 and that is rim 120*a* to separately identify the structure of FIG. 4 from that of FIG. 3. It will be noted that only one set of sufficient legs to engage a specific single size of circular smoke detector are employed. These are sufficiently long to keep the cover spaced from the smoke detector, and the legs are distributed well apart around the circle, usually at equal arcs from one another. It is most stable when the legs are distributed precisely 120° apart. It will be noted that the outside circle of legs is not included in this embodiment. As mentioned in the arrangement of FIGS. 1–3, the outside circle of legs might well be broken off when the smoke detector is used because they serve no function for the particular size detector. If the detector were larger and engaged the outer ring, the inner ring of legs would have to be broken or cut off because they would interfere with moving the cover in toward the smoke detector and not permit proper use of the cover. It is contemplated that in commercial form the legs all will be notched near the cover to permit them to be broken off by bending as with electrical fixtures. In the FIG. 4 embodiment legs are provided to fit only one diameter smoke detector, or like device.

Another aspect of the invention is that the cover need not be flush with the detector cover. In some cases, it may be desirable to space the cover from the detector to allow air flow between them. This can be accomplished simply by enlarging the distance between the notch or should on the leg which attaches to some part of the detector and the cover.

An embodiment where the cams are directed in the opposite direction and cam is done so as to deflect the legs inward, has not been shown. It will be understood by those in the art that other form of the device may be necessary where the part of the smoke detector to be latched against has engaging portions which must be approached from the inside of a ring or inside other engaging structure provided for that purpose.

It will also be apparent to those skilled in the art that the shape of smoke detectors and like devices need not be circular shapes. Shapes can vary greatly, but most likely might be of some sort of square or rectangular form. However, whatever the form, the cover would need to conform, at least somewhat, to that shape and extend to or beyond the edges sufficiently to hide the detector. The legs or support structure needs to be sufficiently long to keep the cover well spaced away from the detector. The number of legs and their configuration can vary substantially, but ordinarily there would need to be at least three legs, and often four legs, for stability with elongated rectangular structures. Reasonable stability could be achieved without having supporting legs on all sides. However, the individual designer of a cover for such configurations may prefer to provide greater stability by putting legs on each side of the geometrical configuration.

Sizes may vary depending upon the size of the device to be covered, but larger devices would probably call for sturdier construction for adequate structural support and stability while employing the principals disclosed herein.

Variations which would occur to one skilled in the art in the structures and patterns and precise form of legs and covers will occur to those skilled in the art are intended to be within the scope of the appended claims.

I claim:

1. A decorative cover for sensing devices, such as smoke detectors, and mounted on a wall or ceiling comprising, a cover member consisting of a generally planer sheet of essentially opaque material of approximately the shape of the device it is covering and somewhat larger than the sensing device to be covered, the outer surface of which cover is capable of being selectively colored, patterned or decorated or left for decoration by a decorator or advertizer, a plurality of resilient connector legs affixed to the inner side of the cover and extending toward the device to be covered, there being multiple sets of legs, the legs of each set are spaced and configured to fit different sizes of sensing device of the same general configuration, with legs for smaller configurations being within larger configurations, whereby, in a particular use, the unused legs that interfere with that use are able to be cut or broken off the decorative cover to avoid interference with placement of the decorative cover over the selected sensing device, in a pattern positioned to engage and deflect against selected distributed points of engagement on the sensing device, and cam surfaces at the free ends of the resilient legs positioned to be the surface of engagement and arranged to laterally deflect the respective legs when they contact and are moved against the distributed points of engagement so that frictional forces imposed by the resilience of the legs while deflected are directed to maintain frictional engagement at the respective points of engagement on the device to be covered due to the collective opposed forces of the distributed legs on the engagement points.

2. The decorative cover of claim 1 in which at least one of the legs is provided with a shoulder beyond the cam surface to act as a latch so that, when the shoulder passes the structure which provides the points of engagement, the resilience of the legs will urge the shoulder behind that structure in the nature of a latch so that each shoulder on each leg will be in position to oppose forces acting to remove the cover from the sensing device.

3. The decorative cover of claim 2 in which all of the legs are provided with a similar latching shoulder at essentially the same location so that all legs are flexible enough to move to latch and are able to move at essentially the same time.

4. The decorative cover of claim 1 in which cams are oriented to contact the points of engagement are selected to move each of the legs outwardly so that its resiliency urges it back inwardly.

5. The decorative cover of claim 3 in which there are at least 3 resilient legs.

6. The decorative cover of claim 5 in which three legs are employed and arranged in a circular configuration with their cams arranged so that a circular device will deflect the legs outwardly.

7. The decorative cover of claim 3 in which four legs are employed and arranged in a circular configuration with their cams arranged so that a circular device will deflect the legs outwardly.

8. The decorative cover of claim 1 in which the device to be covered and the cover are circular and the legs are arranged in a circular pattern.

* * * * *